US008867686B2

(12) United States Patent
Hur et al.

(10) Patent No.: US 8,867,686 B2
(45) Date of Patent: Oct. 21, 2014

(54) HIGH CURRENT SOLID TARGET FOR RADIOISOTOPE PRODUCTION AT CYCLOTRON USING METAL FOAM

(75) Inventors: Min Goo Hur, Gyeonggi-do (KR); Seung Dae Yang, Jeollabuk-do (KR); Sang Wook Kim, Seoul (KR); In Jong Kim, Jeollabuk-do (KR); Sang Mu Choi, Chungcheongnam-do (KR)

(73) Assignee: Korea Atomic Energy Research Institute, Daejeon (KR)

( * ) Notice: Subject to any disclaimer, the term of this patent is extended or adjusted under 35 U.S.C. 154(b) by 667 days.

(21) Appl. No.: 12/821,949

(22) Filed: Jun. 23, 2010

(65) Prior Publication Data

US 2011/0091001 A1 Apr. 21, 2011

(30) Foreign Application Priority Data

Oct. 21, 2009 (KR) ..... 10-2009-0100208

(51) Int. Cl.
*G21G 1/10* (2006.01)
*H05H 6/00* (2006.01)

(52) U.S. Cl.
CPC ..... *H05H 6/00* (2013.01)
USPC ..... 376/115; 376/108; 376/151

(58) Field of Classification Search
USPC ..... 376/115, 151
See application file for complete search history.

(56) References Cited

U.S. PATENT DOCUMENTS 2,935,633 A * 5/1960 Peters ..... 376/115
5,135,704 A * 8/1992 Shefer et al. ..... 376/108
5,410,574 A * 4/1995 Masumoto et al. ..... 376/150
6,468,671 B1 * 10/2002 Streuber ..... 428/613
6,925,137 B1 * 8/2005 Forman ..... 376/190
2005/0178534 A1 * 8/2005 Kienbock et al. ..... 165/148
2006/0137862 A1 * 6/2006 Huang et al. ..... 165/104.33
2007/0040115 A1 2/2007 Publicover et al.
2009/0274259 A1 11/2009 Hur et al.

FOREIGN PATENT DOCUMENTS

KR 10-0691832 B 1/2007
KR 1020090114797 A 11/2009
WO 2007016783 A1 2/2007

OTHER PUBLICATIONS

Barnard et al., "Accelerators and Ion Beam Tradeoffs for Studies of Warm Dense Matter" LLNL May 16, 2005.*

* cited by examiner

*Primary Examiner* — Jack W Keith
*Assistant Examiner* — Sean P Burke
(74) *Attorney, Agent, or Firm* — Fredrikson & Byron, PA

(57) ABSTRACT

Disclosed herein is a high current solid target for radioisotope production at a cyclotron using a metal foam, and more specifically, a high current solid target for isotope production, which attaches a metal foam to the rear surface of the solid target plate. A high current solid target for isotope production including a metal foam according to the present invention may exhibit excellent cooling performances to increase the amount of proton beam current irradiated on the solid target compared to conventional planar-type solid targets. Because the irradiation of the increased proton beam current may increase the amount of an isotope produced per unit time and even an irradiation of proton beam in a short time may allow for production of a desired amount of an isotope, the solid target may be usefully used for production of medical cyclotron nuclides.

8 Claims, 5 Drawing Sheets

HIGH CURRENT SOLID TARGET FOR RADIOISOTOPE PRODUCTION AT CYCLOTRON USING METAL FOAM

CROSS-REFERENCES TO RELATED APPLICATION

This patent application claims the benefit of priority from Korean Patent Application No. 10-2009-0100208, filed on Oct. 21, 2009, the contents of which are incorporated herein by reference.

BACKGROUND OF THE INVENTION

1. Field of the Invention

The present disclosure relates to a high current solid target for radioisotope production at a cyclotron using a metal foam.

2. Description of the Related Art

In general, radioisotope refers to any isotope which emits radiation such as alpha, beta, and gamma rays. Isotope means any element which has the same chemical properties as a common element but differs in atomic weight, and may be largely classified into nuclear reactor nuclides and accelerator (cyclotron) nuclides. Nuclear reactor nuclides are usually used for cancer treatment and accelerator nuclides are usually used for cancer diagnosis.

Because accelerator nuclides among the nuclides are carrier-free and have high specific activity unlike nuclear reactor nuclides, they may significantly reduce exposure of patients to radioactivity due to its decay by electron capture or emission of positrons, and may obtain quality images for diagnosis, accelerator nuclides are usually preferred in nuclear medicine. Furthermore, the positron emitting nuclides are used in positron emission tomography (PET) or single photon emission computed tomography (SPECT) for study of metabolism in the human body and diagnosis of cancer, cardiological disorders, and various diseases caused by nervous system disorders.

With respect to isotopes for medical diagnosis and treatment, their applications are increasing and their demand is on the rise. The demand for medical cyclotron nuclides in Korean nuclear medicine is increasing by 10% every year. However, 80% or more of the demand is dependent on imports, leading to numerous studies on increasing production.

Radioisotopes are produced by irradiating protons or neutrons on stable isotopes. An apparatus or device with which protons or neutrons may be irradiated on stable isotopes refers to a target, and the target device receives high energy protons accelerated by a cyclotron, which in turn induce nuclear reactions in stable isotopes, to change the material state of the stable isotopes such that they may be transformed into radioisotopes.

Target devices for production of radioisotopes include solid, liquid, and gas state targets according to stable isotopes used. $^{18}F$ and $^{123}I$ are produced from gas targets while $^{201}Tl$, $^{103}Pd$, and $^{67}Ga$ are produced from solid targets. In particular, most of the metal-based materials are used as a solid target for production of SPECT isotopes.

FIG. 1 illustrates the configuration and principle of the solid target device. As illustrated in FIG. 1, the solid target device includes a solid target plate 1, a stable isotope 2 plated on the target plate, a cooling unit 3 in which cooling water flows in order to cool the target, and an irradiation station 4 to which proton beam is irradiated. A proton beam for production of isotopes is produced by an accelerator called a cyclotron, and the protons were used to cause nuclear reactions to transform stable isotopes into radioisotopes for production.

FIG. 2 illustrates the structure of a conventional solid target device. The diameter of a part through which a proton beam is introduced is within about 10 mm, and the beam is irradiated by using a wobbler device such that the beam produced by a cyclotron may have as wide and uniform of a distribution as possible. Tilted targets are generally used as a solid target in order to irradiate a high current beam. An area onto which the beam is irradiated may be enlarged by using a tilted target, and it is possible to irradiate a high current beam because the plate thickness for stable isotopes in the target may be significantly reduced.

Protons accelerated by a cyclotron are characterized by a drastic drop in energy according to the density of a material. Because the energy which has been diminished in this way is generated as heat, higher cooling efficiencies are required as the beam current of irradiation increases. When heat is generated, a target does not maintain the intrinsic solid state of metal and is vaporized by a proton beam therefore the degree of vacuum of the cyclotron is reduced. As a result, not only may the performance be degraded, but the isotope productivity may also be reduced due to a lowered nuclidic purity in most cases, arising from the inability to maintain an energy band sufficient to irradiate onto a target material. For this reason, it is very important to cool the target surface of a solid target. Therefore, it is necessary to enhance the cooling efficiency of a solid target in order to secure the stability of production yield, reduce irradiation time, and increase the quantity of an isotope produced during irradiation of a high current proton beam.

A heat transfer coefficient by a fluid flow may be defined as h in the following Formula 1.

$$h = \frac{Q}{A}\frac{1}{\Delta T}\ [\mathrm{W/m^2K}] \qquad \text{[Formula 1]}$$

In Formula 1, Q is a heat quantity transferred, A is a heat transfer area, and ΔT is a temperature difference. As seen from Formula 1, the cooling efficiency becomes high as the heat transfer coefficient increases. Therefore, a heat transfer area must be increased or a temperature difference between two media must be enhanced in order to enhance the cooling efficiency.

Conventional approaches for enhancing the cooling efficiency have been largely divided into the two directions: increasing the cooling flow rate in order to maintain a constant temperature difference and enhancing the cooling efficiency by increasing the irradiated area to increase a heat transfer area.

Because an interval for which fluids are not flowing due to frictional force between a metal surface and cooling water is created by methods for increasing the cooling flow rate, a flow channel must be narrowed for flow of cooling water in order to prevent this. In order to maintain the cooling efficiency by limitation of a limited flow channel, measures to increase the pressure of cooling water must be taken and as a result, problems such as leakage of cooling water and leakage into a vacuum unit occur.

According to methods for increasing the irradiated area, it is difficult to perform chemical treatments by increasing the plated area of a stable isotope, there is a limitation in size arising from a problem of beam uniformity in an accelerator, and expensive stable isotopes must be inevitably used for a larger area.

Thus, the present inventors have conducted studies to enhance the cooling efficiency of high current solid targets for radioisotope production, discovered that a high current solid target for isotope production which attaches a metal foam to the rear surface of the solid target plate exhibited excellent cooling performances such as increasing the amount of the proton beam current irradiated on the solid surface by 1.5 to 2-fold compared to conventional planar-type solid targets, and completed the present invention.

SUMMARY OF THE INVENTION

The present invention provides a metal foam for cooling a solid target and also provides a high current solid target for isotope production having the metal foam attached to the solid target.

In an embodiment of the invention, a high current solid target for isotope production is provided. The solid target comprises a solid target plate having a rear surface and a metal foam attached to the rear surface of the solid target plate.

In some embodiments, the solid target plate and the metal foam are made of an identical metal. In other embodiments, the solid target plate includes a groove in the rear surface to which a metal foam is attached along the shape of the plate on the rear surface of the solid target plate.

In another embodiment of the present invention a metal foam is provided for cooling a high current solid target for isotope production. The metal foam can be attached a surface of a solid target, preferably to the rear surface of a solid target. The metal foam may be formed of the same or different metal as the solid, target, preferably of the same metal as the target.

A further embodiment of the present invention provides the use of a metal foam for cooling a high current solid target during isotope production.

A high current solid target for isotope production including a metal foam according to the present invention may exhibit excellent cooling performances to increase the amount of proton beam current irradiated on the solid target compared to conventional planar-type solid targets. Because the irradiation of the increased proton beam current may increase the amount of an isotope produced per unit time and even an irradiation of proton beam in a short time may allow for production of a desired amount of an isotope, the solid target may be usefully used for production of medical cyclotron nuclides.

DESCRIPTION OF THE PREFERRED EMBODIMENTS

Figure 1:
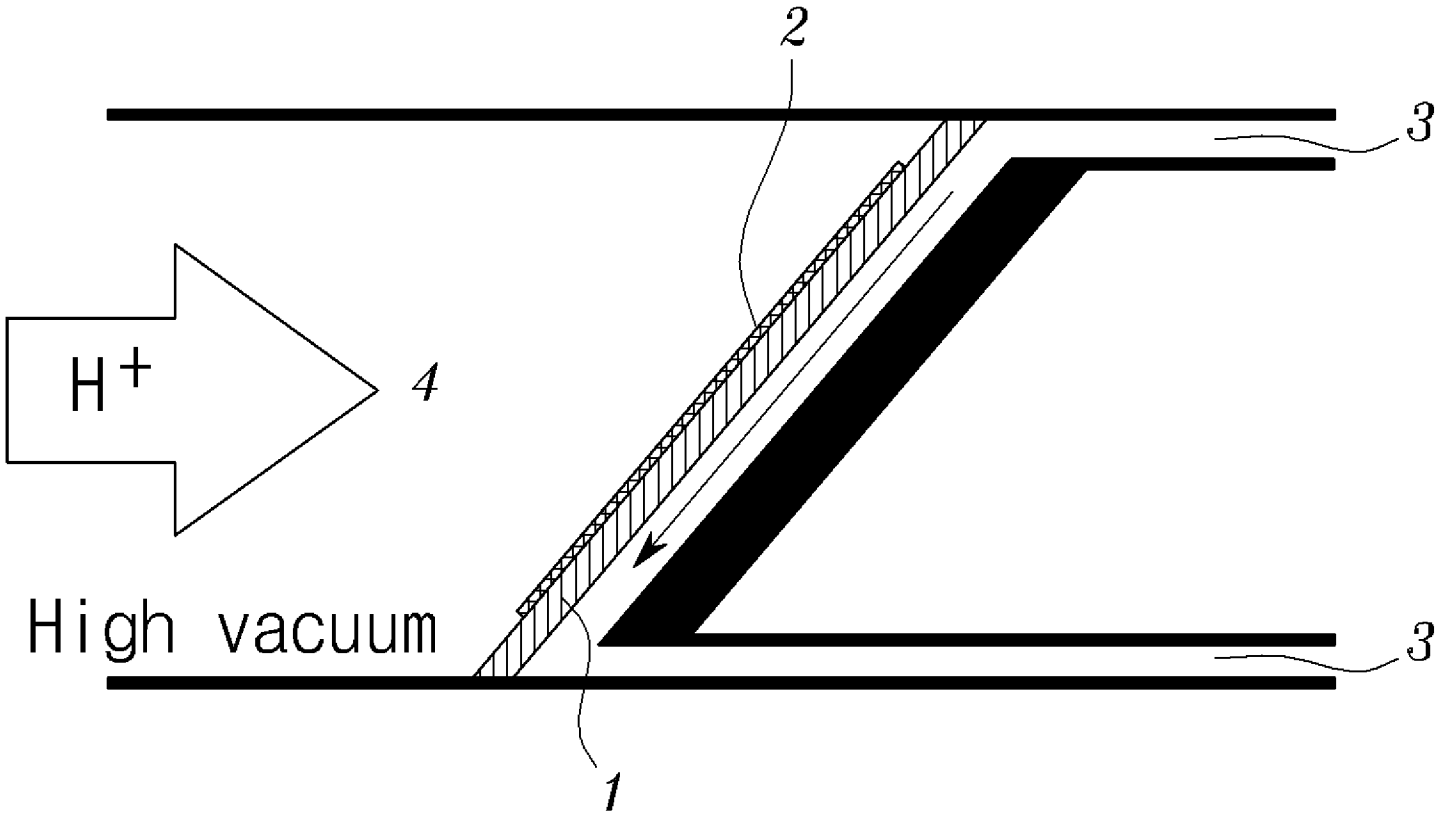
FIG. 1 is a schematic view illustrating the configuration and principle of a solid target device.
Figure 2:
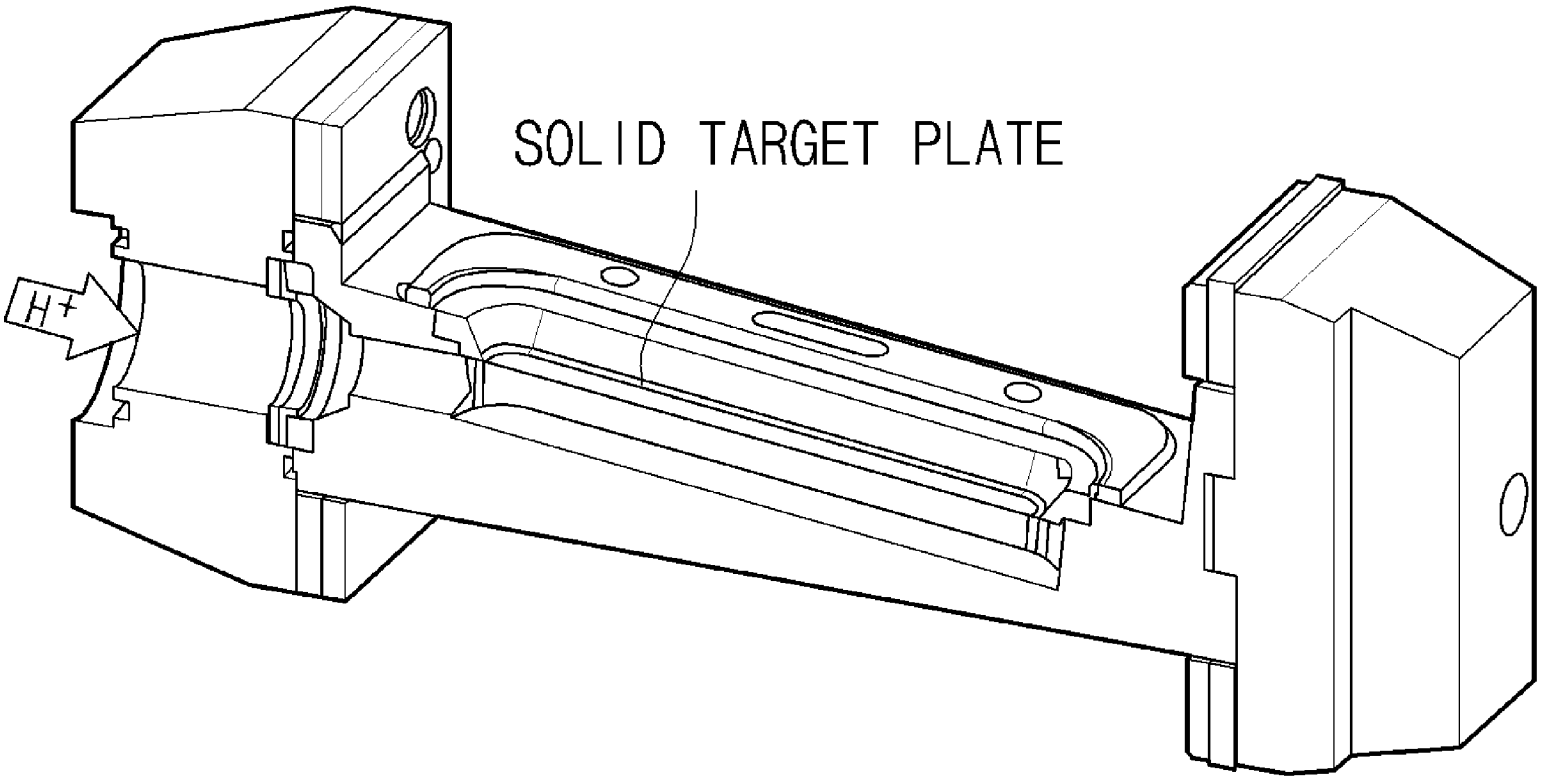
FIG. 2 is a schematic view illustrating the structure of a conventional solid target device.
Figure 3A:
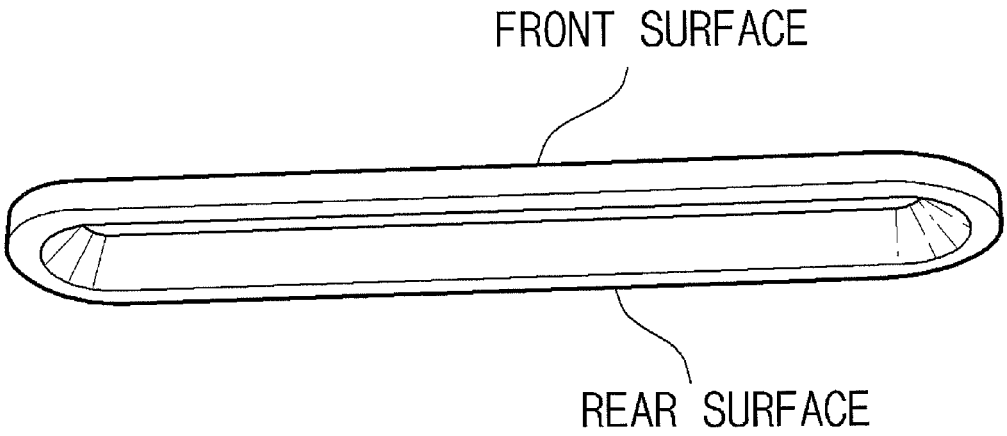
FIGS. 3A and 3B are a set of views illustrating a solid target plate according to the present invention prior to attaching a metal foam to the rear surface of the solid target plate.
Figure 3B:
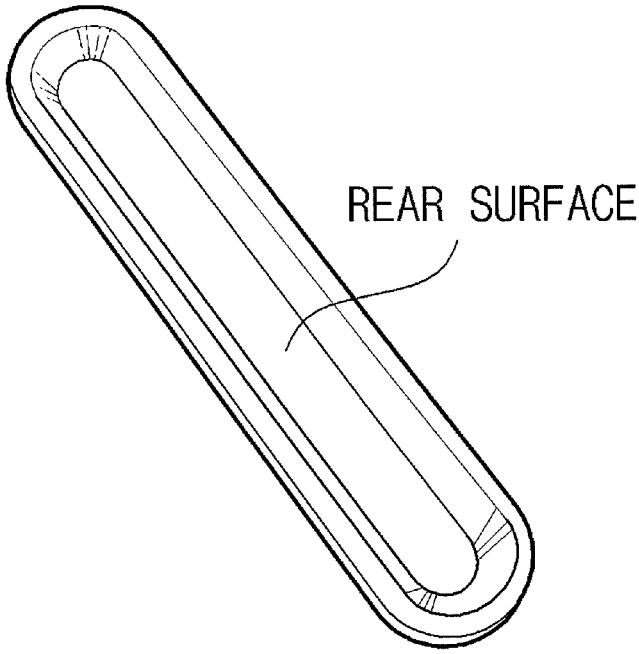
Figure 4A:
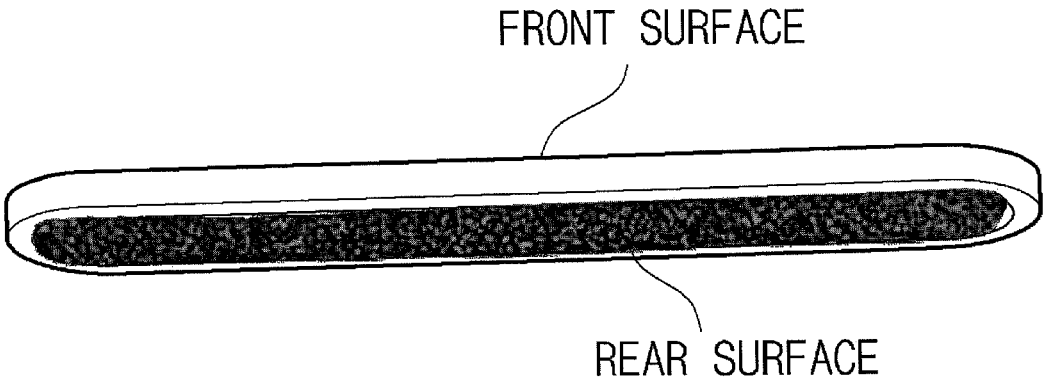
FIGS. 4A and 4B are a setof views illustrating a solid target plate according to the present invention after attaching a metal foam to the rear surface of the solid target plate.
Figure 4B:
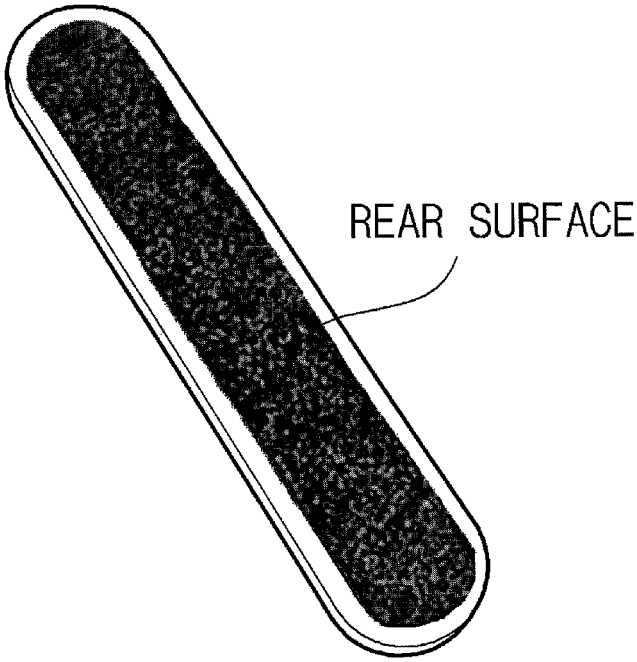

Features and advantages of the present invention will be more clearly understood by the following detailed description of the present preferred embodiments by reference to the accompanying drawings. It is first noted that terms or words used herein should be construed as meanings or concepts corresponding with the technical spirit of the present invention, based on the principle that the inventor can appropriately define the concepts of the terms to best describe his own invention. Also, it should be understood that detailed descriptions of well-known functions and structures related to the present invention will be omitted so as not to unnecessarily obscure the important point of the present invention.

In an embodiment of the present invention, a high current solid target is provided for isotope production whose cooling efficiency is improved.

In another embodiment of the present invention a metal foam is provided for cooling the high current solid target for isotope production.

In yet another embodiment of the present invention a high current solid target is provided for isotope production which attaches a metal foam to the rear surface of the solid target plate.

Hereinafter, the present invention will be described in detail.

A high current solid target for isotope production according to the present invention attaches a metal foam to the rear surface of a solid target plate.

The metal foam included in the rear surface of the solid target plate according to the present invention is preferably made of a metal which has a sponge structure in which there are a multiplicity of pores inside. The pores inside the sponge structure are preferably interconnected with each other such that a fluid such as cooling water etc. may flow.

FIGS. 3A, 3B, 4A and 4B illustrate a solid target plate prior to and after attaching a metal foam according to one aspect of the present invention. A solid target according to the present invention may allow the metal foam described above to be attached to the rear surface of the solid surface plate to increase a heat transfer area by several to several tens of times compared to cases of direct planar contact of a fluid, for example, cooling water with a solid target plate of metal without mediation by any metal foam, wherein the metal foam has pores inside. Generally, the amount of heat transfer per unit time increases as a heat transfer area increases. Therefore, a solid target including a metal foam having a large heat transfer area according to the present invention may increase the cooling efficiency of the solid target as a result of a smoother heat conduction by convection than planar-type metals when an equal amount of fluid is flowing.

Furthermore, the solid target plate according to the present invention and a metal foam provided in the rear surface thereof are preferably made of an identical metal in terms of heat conduction efficiency.

In the solid target for isotope production according to the present invention, the shape of the rear surface of the solid target plate preferably includes a groove such that a metal foam may be stably attached along the shape of the plate, without being limited to any particular shape as long as it may perform heat transfer efficiently.

The present invention provides a metal foam for cooling a solid target, which is attached to the rear surface of the high current solid target for isotope production.

The metal foam according to the present invention is preferably made of a metal which has a sponge structure in which there are a multiplicity of pores inside.

The pores inside the sponge structure according to the present invention are preferably interconnected with each other such that fluids may flow.

Furthermore, the metal foam according to the present invention is preferably made of a metal identical to the solid target plate.

The cooling effects of a high current solid target for isotope production according to one aspect of the present invention were measured in the following manner.

Figure 5A:
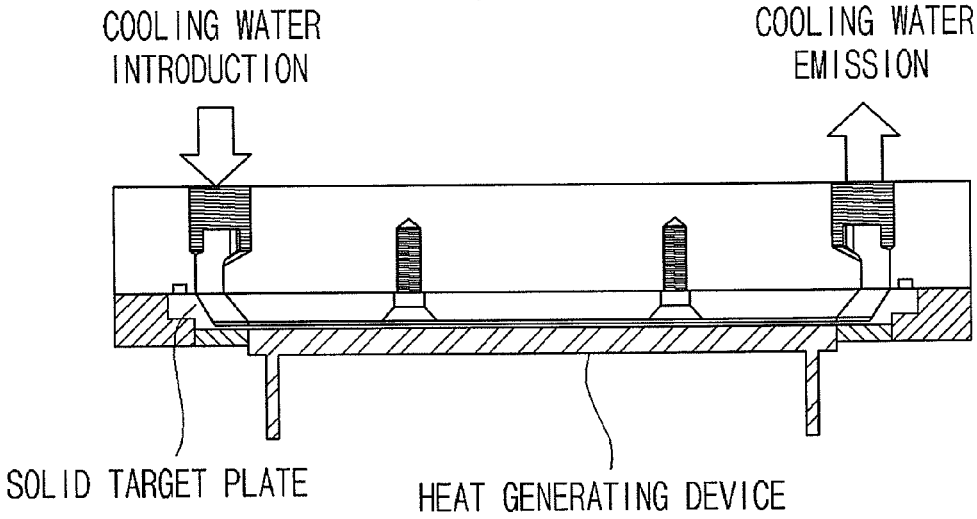
FIGS. 5A and 5B are a set of views illustrating cooling experimental devices for measuring the cooling effect of a solid target with a metal foam according to the present invention FIG. 5A a conventional planar-type solid target and FIG. 5B a solid target using a metal foam according to the present invention).
Figure 5B:
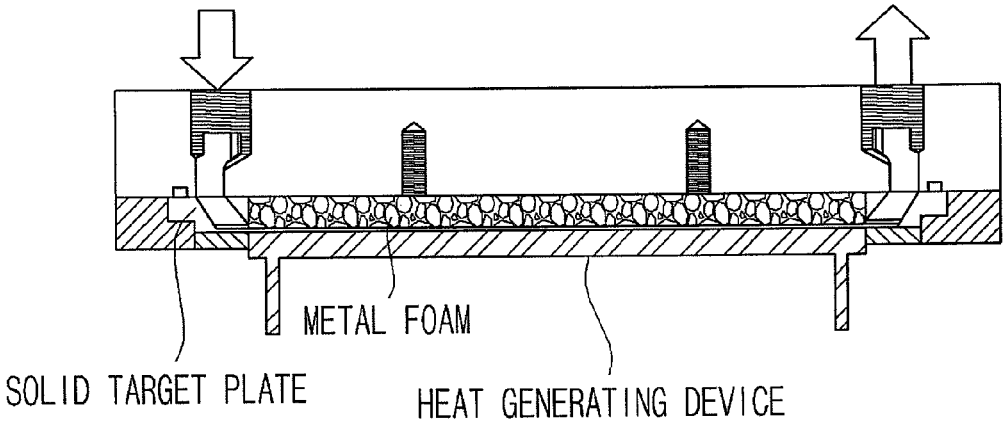

FIG. 5 illustrates cooling experimental devices in order to compare a solid target using a metal foam according to the present invention with a conventional planar-type solid target. Because a heat generated by protons irradiated at a cyclotron is defined as P(W)=E(MeV)×I(μA), cooling performances were simulated by contacting a heat generating device instead of the proton beam at a cyclotron with the surface of the target. FIG. 5 (*a*) illustrates a cooling experimental device of a conventional planar-type solid target, while FIG. 5 (*b*) illustrates a cooling experimental device using a metal foam according to the present invention. When cooling water was flown under the condition in which the surface temperature of the solid target was maintained constantly at 60° C., cooling flow rate (LPM) of the cooling water flowing along the target, cooling time (Δt), and solid target surface temperature (T) maintaining through the cooling were measured. An identical cooling pump was used, the temperature of the cooling water was maintained at 19° C., and the amount of current applied to a heating apparatus during the cooling process was constantly maintained. The results were summarized in the following Table 1.

TABLE 1

| | Conventional solid target | Solid target according to the present invention |
|---|---|---|
| Initial temperature ($T_1$, ° C.) | 60 | 60 |
| Saturated temperature ($T_2$, ° C.) | 55 | 49 |
| Temperature change (ΔT, ° C.) | 5 | 11 |
| Cooling flow rate (LPM) | 10 | 6 |
| Elapsed time to saturated (cooling time) (Δt, sec) | 28 | 15 |

Referring to Table 1, it can be known that a solid target using a metal foam according to the present invention, in spite of a decrease in cooling flow rate (a drop in cooling water pressure) due to the resistance of the metal foam, has excellent cooling time and temperature change by about 2 fold compared to conventional solid targets.

Through the results, it can be known that a solid target using a metal foam according to the present invention may maintain low temperatures more stably than when a current amount of the proton beam irradiated is identical. It can be also understood that when a current amount of the proton beam is irradiated such that an identical target surface temperature may be obtained, the current amount of the proton beam irradiated may be increased by 1.5 to 2 fold.

Therefore, a high current solid target for isotope production including a metal foam according to the present invention may exhibit excellent cooling performances to increase the amount of proton beam current irradiated on the solid target compared to conventional planar-type solid targets. Because the irradiation of the increased proton beam current may increase the amount of an isotope produced per unit time and even an irradiation of proton beam in a short time may allow for production of a desired amount of an isotope, the solid target may be usefully used for production of medical cyclotron nuclides.

The scope of the present invention includes the invention described in the appended claims and any equivalent inventions. In addition, various modifications may be made without departing from the spirit and scope of the present invention, such modifications should not be considered as departing from the spirit and scope of the present invention, and all such modifications likely to be apparent to those skilled in the art are intended to be encompassed within the following claims.

What is claimed is:

1. A high current solid state target for radioisotope production, comprising a solid state target plate having a front surface and a rear surface, a stable isotope plated on the front surface of the solid state target plate and a metal foam attached only to the rear surface of the solid state target plate wherein the metal foam is made of a metal which has a sponge structure in which there is a multiplicity of pores inside, and wherein the pores inside the sponge structure are interconnected with each other to allow a cooling fluid to flows therethrough when the solid state target is in use in a radioisotope production.

2. The target as set forth in claim 1, wherein the solid state target plate and the metal foam are made of an identical metal.

3. The target as set forth in claim 1, wherein the solid state target plate includes a groove in the rear surface to which a metal foam is attached along the shape of the plate on the rear surface of the solid state target plate.

4. The target as set forth in claim 1, wherein the cooling fluid comprises cooling water.

5. A high current solid state for radioisotope production, comprising a solid state target plate having a front surface and a rear surface, stable isotope plated on the front surface of the solid state target plate and a metal foam attached only to the rear surface of the solid state target plate to allow a cooling fluid to flow through the metal foam when the solid state target is in use in a radioisotope production.

6. The target set forth in claim 5, wherein the solid state target plate and the metal foam are made of an identical metal.

7. The target as set forth in claim 5, wherein the solid state target plate includes a groove in the rear surface to which a metal foam is attached along the shape of the plate on the rear surface of the solid state target plate.

8. A high current solid state target for radioisotope production, comprising a solid state target plate having a front surface and a rear surface, a stable isotope plated on the front surface of the solid state target plate, a groove in the rear surface, and a metal foam attached in the groove in the rear surface of the solid state target plate wherein the metal foam is made of a metal which has a sponge structure in which there are a multiplicity of pores inside, and the pores inside the sponge structure are interconnected with each other to allow a cooling water to flows therethrough when the solid state target is in use in a radioisotope production.

* * * * *